US006613163B1

(12) United States Patent
Pfeifenbring et al.

(10) Patent No.: US 6,613,163 B1
(45) Date of Patent: Sep. 2, 2003

(54) STEEL BAND WITH GOOD FORMING PROPERTIES AND METHOD FOR PRODUCING SAME

(75) Inventors: Karlfried Pfeifenbring, Duisberg (DE); Andrew E. Munera, Youngstown, OH (US); Ferdinand Schmidt, Duesseldorf (DE); Rob Van Der Mije, Heerhugowaard (NL); Jaap Neeft, Heemskerk (NL); Uwe Schoelich, Cologne (DE)

(73) Assignee: Hille & Mueller GmbH, Duesseldorf (DE)

( * ) Notice: Subject to any disclaimer, the term of this patent is extended or adjusted under 35 U.S.C. 154(b) by 0 days.

(21) Appl. No.: 09/869,238

(22) PCT Filed: Dec. 22, 1999

(86) PCT No.: PCT/EP99/10272

§ 371 (c)(1),
(2), (4) Date: Oct. 3, 2001

(87) PCT Pub. No.: WO00/40765

PCT Pub. Date: Jul. 13, 2000

(30) Foreign Application Priority Data

Dec. 30, 1998 (DE) ..... 198 61 014

(51) Int. Cl.[7] ..... C21D 8/04

(52) U.S. Cl. ..... 148/518; 148/530; 148/532; 148/533; 428/677

(58) Field of Search ..... 148/518, 530, 148/532, 533, 603; 420/121; 428/677

(56) References Cited

U.S. PATENT DOCUMENTS 4,410,372 A * 10/1983 Takahashi et al. ..... 148/530
5,456,816 A * 10/1995 Watanabe et al. ..... 148/518
5,470,403 A * 11/1995 Yoshinaga et al. ..... 148/603
5,855,696 A * 1/1999 Tezuka et al. ..... 148/603

* cited by examiner

*Primary Examiner*—George Wyszomierski
(74) *Attorney, Agent, or Firm*—Hahn Loeser + Parks LLP; Stephen L. Grant

(57) ABSTRACT

The invention relates to a method for producing band-shaped steel for components which are produced by drawing and ironing. The invention also relates to a steel band which can be drawn or ironed and which has been produced by the inventive method. The hot strip is cold-worked in one or more steps at a ratio of the cold roll of at least 86%. Furthermore, at least one side of the band material is provided with a galvanically produced coating containing Ni, Co, Cu, Fe, Sn, In, Pd, Bi and/or the alloys thereof or with a roll-bonded coating containing Cu and/or brass and/or the alloys thereof. The aim of the invention is to carry out the inventive method with the fewest processing steps possible and with low production costs. The method therefore comprises the steps: etching, cold rolling in one or two steps, annealing the coiled band (coil-annealing), optionally rerolling the band. The hot strip preferably contains boron with a percentile of 0.0013 and 0.0060 percent by weight, whereby the weight ratio of boron to nitrogen amounts to 0.5 to 2.5.

29 Claims, No Drawings

STEEL BAND WITH GOOD FORMING PROPERTIES AND METHOD FOR PRODUCING SAME

This invention relates to a procedure for the production of steel band for the manufacture of parts fabricated by draw and ironing process, during which a hot rolled steel band is cold formed, in one or multiple stages, with a cold-rolling coefficient of at least 86%°, where at least one side of the band material is coated with a galvanic layer containing Ni, Co, Cu, Fe, In, Pd, Bi and/or their alloys, or with a roll-bonded cladding containing Cu and/or brass and/or their alloys.

Cold rolled steel band is used for the fabrication of rotationally symmetrical cold formed parts such as battery shells. The procedures applied during the cold forming are deep drawing and ironing, where the latter procedure is also called DI procedure (for drawing and ironing). Due to rising requirements as for the application and use properties of such steel band material, the industry seeks constantly improving mechanical properties and especially better forming properties. Good plasticity is characterized by high r values for anisotropy characterizing the deep-drawing quality, and by n values characterizing drawing and ironing properties, as well as by high stretching values. It is also advantageous if the forming properties are the same lengthwise, crosswise and diagonally, i.e., if they are isotropic. The advantage of isotropic properties of the steel sheet are substantially reflected in the uniformity of the material flow during cold drawing or drawing and ironing so that no or very little earing occurs which results in a reduction of metal sheet waste.

In order to achieve an almost isotropic forming, steel sheet with very small permissible thickness variations in a texture-free and homogeneous rolled band or sheet is used.

The undesirable earing and its causes are explained in detail in the magazine "Blech, Rohre, Profile" [Metal Sheet, Tubes, Profiles], September 1977 issue, on pages 341 through 346. The same article also describes that an earing-free material can normally be produced only by normalizing (annealing for relieving stresses) in a continuous annealing furnace at a temperature of about 1000° C. However, the operation of a continuous annealing furnace at such a high temperature requires high investment and operation costs.

DE-38 03 064 C1 reveals that low values for anisotropy and therefore a low tendency to form earing is achieved for globular-type steels that the steel has a higher content of titanium of up to 0.04% using a cold rolling coefficient over 80%. However, such high rolling coefficients reach the stretching limit of steel of over 250 N/mm$^2$. In addition, steels stabilized by an ingredient of titanium are known to require high recrystallization temperatures, which would lead to a high tendency of individual band layers to stick together if such a steel band should be annealed in coiled state. However, the resulting damage of the steel sheet surface is very undesirable for high-value products and thus would result in a high rate of rejected products.

The application of a continuously operated band annealing furnace for the production of steel sheet designed for the fabrication of parts manufactured by drawing and ironing is also revealed in the publications U.S. Pat. No. 5,078,809, WO 98/06881 and EP 0 822 266 A1. The latter document describes steel with a low content of carbon, whose steel analysis further contains boron with a content between 0.0005 and 0015 weight %. The aforementioned lower limit is based on the requirement to increase the resistance of the steel sheet to corrosion by adding boron to the steel melting charge. The document EP 0 822 266 A1 justifies the upper limit of 0.0015 weight % by the circumstance that a higher boron content would cause forming defects in cylindric parts.

The document DE 20 19 494 A describes a procedure for the production of corrosion-resistant coated steel. A coating of at least one metal from the group Co, Cu, Ni and Ti is applied on a pickled, hot rolled steel band, and the hot rolled steel band, with the coating on it, is then cold reduced to final size. During the one or several stage cold reduction process, a reduction coefficient of about 90% and more can be achieved. The cold reduced steel band is then annealed for recrystallization, where the annealing is preferably performed in a continuous annealing procedure. In case only one annealing step is required, it can be done by means of a box annealing procedure, where a temperature in the range between 566° C. and 621° C. should be maintained for a time period of 1 to 5 hours. The goal of such procedure is to prevent extensive formation of an alloy of the metal in the coating and the underlying band steel during the vapor-depositing of the coating. An exemplary composition of the steel plates entering the manufacturing process is: 0.035% C, 0.49%, 0.10% P, 0.11% S and 0.035% Si. This document does not mention a possible content of boron.

The document GB 2 101 156 A describes a procedure for the production of a steel band for deep drawing. The procedure described in this document includes conventional hot rolling and cold rolling steps applied to an aluminum-killed steel. The steel used according to this document contains no more than 0.007% nitrogen and such a quantity of boron that corresponds with a boron to nitrogen ratio of 0.5 to 2.5. In the provided examples the actual quantity of boron is between 0.0025% and 0.0040%. According to this document, any annealing of the steel band is performed exclusively in the form of a continuous annealing procedure.

The document JP-A-2 267 242 describes a procedure for the production of a cold rolled steel band made of aluminum-killed steel with a very low content of carbon. In order to chemically bond the nitrogen contained in the steel, aluminum is added to the starting steel material, which will then chemically bind the nitrogen during the subsequent hot rolling process to form aluminum nitride. After the following pickling and cold rolling procedures the steel band is annealed in a box annealing procedure. According to this document, the steel band does not have any coating, and the steel does not contain any boron.

Finally, the document DE-195 47 181 C1 describes a type of steel with content of titanium, vanadium, or niobium, where a sort of a mixed-grain steel material is achieved based on certain hot rolling conditions under the gamma range of the iron-carbon diagram and based on a high reeling temperature in the hot band. With rolling coefficients between 50 and 85%, this mixed grain leads to a lower tendency to form earing; however it also leads to the formation of course, band-shaped cementite, which causes undesirable structures on the steel sheet surface during the drawing of thin parts with high surface requirements, and, therefore, causes a high rate of defective products.

The task of this invention is to develop a general procedure leading to material properties, as for its anisotropy, very close to those of materials produced by normal annealing, while allowing relatively low operation costs with as few production steps as possible. The annealing process is supposed to produce a globular grain material; furthermore, the steel band produced by the invented procedure must show no disadvantages based on ageing or higher mechanical values due to high rolling coefficients.

According to this invention, the procedure of the aforementioned type suggests that the procedure steps performed after hot rolling include:

pickling one- or multiple-stage cold rolling annealing of the band in coiled state (coil annealing)

possibly also temper rolling of the band.

The warm band preferably contains boron in a portion between 0.0013 and 0.006 weight %, where the weight ratio of boron to carbon is from 0.5 to 2.5. The preferred goal should be to achieve a content of boron between 0.0013 and 0.003 weight %.

In order to achieve a uniform structure of the band material, hot rolling procedure is applied, preferably with the rolling temperature of over 870° C. and a reeling temperature under 710° C.

In order to achieve a very small earing formation during the deep drawing or drawing and ironing, and especially a relative earing of a maximum of 2.5%, the value of the vertical anisotropy Δr of the band after coil annealing should not amount to more than +/−0.12.

Finally, this invention proposes a steel band capable to be processed by a deep drawing or drawing and ironing process, which is produced in a procedure according to at least one of the patent claims.

The procedure that is the subject of this invention as well as the steel band capable to be processed by a deep drawing or drawing and ironing process that is produced in a procedure according to this invention are explained in further text by means of an example.

The base material is a hot band with a starting thickness of 1.2 to 8 mm, preferably of 2.0 to 2.5 mm. The steel analysis of the used hot band is, in the first version, as follows:

| | Weight percentage - minimum | Weight percentage - maximum |
|---|---|---|
| C | 0.010 | 0.065 |
| Mn | 0.100 | 0.275 |
| P | | 0.040 |
| S | | 0.040 |
| Si | | 0.050 |
| N | | 0.0040 |
| Al (acid-soluble) | | 0.070 |
| B | 0.0013 | 0.0060 |
| Cu | | 0.100 |
| Sn | | 0.100 |
| Cr | | 0.100 |
| Ni | | 0.100 |
| Mo | | 0.030 |
| Fe | | Rest |
| B/N (ratio) | 0.5 | 2.5 |

According to the second version, which is especially preferred, the steel composition is as follows:

| | Weight percentage - minimum | Weight percentage - maximum |
|---|---|---|
| C | 0.010 | 0.040 |
| Mn | 0.140 | 0.200 |
| P | | 0.020 |
| S | | 0.020 |
| Si | | 0.030 |
| N | | 0.0025 |
| Al (acid-soluble) | | 0.035 |
| B | 0.0013 | 0.0030 |

-continued

| | Weight percentage - minimum | Weight percentage - maximum |
|---|---|---|
| Cu | | 0.040 |
| Sn | | 0.010 |
| Cr | | 0.040 |
| Ni | | 0.040 |
| Mo | | 0.010 |
| Fe | | rest |
| B/N (ratio) | 0.8 | 0.8 |

The hot rolling of the band occurs at an end rolling temperature of over 870° C. and a coiling temperature under 710° C. in order to achieve an especially uniform structure of the steel band. During experiments we were able to determine that the stretching limit values of the edge and of the band middle differ by less than 15 N/mm$^2$.

A boron content higher than indicated above requires significantly bigger hot rolling forces. On the contrary, a boron content of less than 0.0060 weight per cent allows working with moderate hot rolling forces. This then leads also to a reduction of thickness tolerances throughout the width of the steel sheet due to a significantly lower deflection of the rolls.

The hot-rolled band is subsequently pickled and then subjected to a one- or two-stage cold rolling process. The cold-rolling coefficient is 86% or more. In this manner, the starting material of a thickness of 1.2 to 8 mm can be cold rolled to an end thickness of 0.1 to 1.0 mm. The cold rolling is followed by a recrystallization annealing in coil, i.e. annealing of the band in coiled state). The effects of such a recrystallization annealing are very similar to those of normal annealing usually performed in continuous furnaces with the band spread out. The coil annealing is then followed by temper rolling of the band in order to improve its surface and to fix specific mechanical and technical values.

The steel band is coated, on at least one of its two surfaces, with a galvanically produced layer. This coating may contain Ni, Co, Cu, Fe, Sn, In, Pd, Bi and/or their alloys. Within the scope of the entire process, the electrolytic processing can follow the first stage or the second stage of the cold rolling, and only then follows the annealing in coil as well as the temper rolling of the band. An additional annealing step between the two stages of cold rolling is also possible.

Besides the described galvanization process, another method of applying a coating on at least one side of the steel sheet is roll-bonding of a metal foil. In this case, the hot rolling and pickling of the steel band is followed first by roll-bonding and then by coil annealing. Another version is that a new cold rolling and a second annealing in coil can follow the first annealing in coil, before the steel band is finally subjected to temper rolling to improve its surface.

Layers of copper and/or brass and/or their alloys are especially suitable for the roll-bonding. Finally, the steel band with a coating applied by galvanization process or by roll-bonding can be further improved by another non-metal layer or a galvanic layer in order to achieve special effects and properties.

If a galvanization process is used, the thickness of the entire galvanic coating on one or both sides of the steel band should be between 0.1 μm and 8 μm. If roll-bonding is used, the sum of the one-side or two-side layers of bonded metal should be up to 50% of the entire thickness of the steel band.

In order to achieve a very low tendency of the steel band to form earing, the parameters of the cold rolling must be set up in such a manner as to achieve a vertical anisotropy of A r of a maximum of +/−0.12 after the first annealing in coil, which corresponds with a relative earing value of 2.5%.

Another advantage is that the result is also a material of globular grain suitable for the subsequent deep drawing and/or drawing and ironing process.

What is claimed is:

1. A procedure for producing a steel band designed for the manufacture of parts fabricated by a deep-drawing or a drawing and ironing process, where the steel band is hot rolled, and at least one side of the band is coated with at least one of: a galvanic layer containing at least one metal selected from a group consisting of Ni, Co, Cu, Fe, Sn, In, Pd, Bi and the alloys thereof, or, with a roll bonded layer containing at least one metal from a group consisting of Cu, brass and alloys of copper and brass, wherein the procedure steps after the hot rolling include at least the steps of: pickling, cold rolling in one or two steps with a cold rolling coefficient of at least 86%, and coil annealing of the band, wherein the coating is applied in the case of a galvanic coating upon the band after the cold-rolling or, respectively, in the case of roll bonding, during the cold rolling, but, in any case, before annealing, wherein the hot band contains between 00013 and 0.0060 weight per cent of boron, and wherein the weight ratio of boron to nitrogen is 0.5 to 2.5.

2. The procedure according to claim 1, wherein the boron content is between 0.0013 and 0.0030 weight per cent.

3. The procedure according to claim 2, wherein hot rolling occurs at a final rolling temperature of over 870° C. and coiling at a temperature of under 710° C.

4. The procedure according to claim 3, wherein the value of anisotropy Δr of the band after coil annealing amounts to no more than +/−0.12.

5. The procedure according to claim 4, wherein the following weight content in the hot band:

| | Weight percentage - minimum | Weight percentage - minimum |
|---|---|---|
| C | 0.010 | 0.065 |
| Mn | 0.100 | 0.275 |
| P | | 0.050 |
| S | | 0.050 |
| Si | | 0.060 |
| N | | 0.0060 |
| B | | 0.0030 |

6. The procedure according to claim 5, wherein the hot band is 1.2 mm to 8 mm thick before the cold rolling.

7. The procedure according to claim 2, wherein the value of anisotropy Δr of the band after coil annealing amounts to no more than +/−0.12.

8. The procedure according to claim 7, wherein the following weight content in the hot band:

| | Weight percentage - minimum | Weight percentage - minimum |
|---|---|---|
| C | 0.010 | 0.065 |
| Mn | 0.100 | 0.275 |
| P | | 0.050 |
| S | | 0.050 |
| Si | | 0.060 |
| N | | 0.0060 |
| B | | 0.0030 |

9. The procedure according to claim 8, wherein the hot band is 1.2 mm to 8 mm thick before the cold rolling.

10. The procedure according to claim 2, wherein the following weight content in the hot band:

| | Weight percentage - minimum | Weight percentage - minimum |
|---|---|---|
| C | 0.010 | 0.065 |
| Mn | 0.100 | 0.275 |
| P | | 0.050 |
| S | | 0.050 |
| Si | | 0.060 |
| N | | 0.0060 |
| B | | 0.0030 |

11. The procedure according to claim 10, wherein the hot band is 1.2 mm to 8 mm thick before the cold rolling.

12. The procedure according to claim 2, wherein the hot band is 1.2 mm to 8 mm thick before the cold rolling.

13. The procedure according to claim 1, wherein hot rolling occurs at a final rolling temperature of over 870° C. and coiling at a temperature of under 710° C.

14. The procedure according to claim 13, wherein the value of anisotropy Δr of the band after coil annealing amounts to no more than +/−0.12.

15. The procedure according to claim 14, wherein the following weight content in the hot band:

| | Weight percentage - minimum | Weight percentage - minimum |
|---|---|---|
| C | 0.010 | 0.065 |
| Mn | 0.100 | 0.275 |
| P | | 0.050 |
| S | | 0.050 |
| Si | | 0.060 |
| N | | 0.0060 |
| B | | 0.0030 |

16. The procedure according to claim 15, wherein the hot band is 1.2 mm to 8 mm thick before the cold rolling.

17. The procedure according to claim 13, wherein the following weight content in the hot band:

| | Weight percentage - minimum | Weight percentage - minimum |
|---|---|---|
| C | 0.010 | 0.065 |
| Mn | 0.100 | 0.275 |
| P | | 0.050 |
| S | | 0.050 |
| Si | | 0.060 |
| N | | 0.060 |
| B | | 0.0030 |

18. The procedure according to claim 17, wherein the hot band is 1.2 mm to 8 mm thick before the cold rolling.

19. The procedure according to claim 1, wherein the value of anisotropy Δr of the band after coil annealing amounts to no more than +/−0.12.

20. The procedure according to claim 19, wherein the following weight content in the hot band:

| | Weight percentage - minimum | Weight percentage - minimum |
|---|---|---|
| C | 0.010 | 0.065 |
| Mn | 0.100 | 0.275 |
| P | | 0.050 |
| S | | 0.050 |
| Si | | 0.060 |

-continued

| | Weight percentage - minimum | Weight percentage - minimum |
|---|---|---|
| N | | 0.0060 |
| B | | 0.0030 |

21. The procedure according to claim 20, wherein the hot band is 1.2 mm to 8 mm thick before the cold rolling.

22. The procedure according to claim 1, wherein the following weight content in the hot band:

| | Weight percentage - minimum | Weight percentage - minimum |
|---|---|---|
| C | 0.010 | 0.065 |
| Mn | 0.100 | 0.275 |
| P | | 0.050 |
| S | | 0.050 |
| Si | | 0.060 |
| N | | 0.0060 |
| B | | 0.0030 |

23. The procedure according to claim 22, wherein the hot band is 1.2 mm to 8 mm thick before the cold rolling.

24. The procedure according to claim 1, wherein the hot band is 1.2 mm to 8 mm thick before the cold rolling.

25. The procedure according to claim 1, wherein the procedure steps after the hot rolling include temper rolling of the steel band.

26. The steel band capable to be processed by deep drawing or by drawing and ironing produced in a procedure according to claim 9.

27. The steel band capable to be processed by deep drawing or by drawing and ironing produced in a procedure according to claim 6.

28. The steel band capable to be processed by deep drawing or by drawing and ironing produced in a procedure according to claim 21.

29. The steel band capable to be processed by deep drawing or by drawing and ironing produced in a procedure according to claim 23.

* * * * *

UNITED STATES PATENT AND TRADEMARK OFFICE

CERTIFICATE OF CORRECTION

PATENT NO. : 6,613,163 B1
DATED : September 2, 2003
INVENTOR(S) : Pfeifenbring et al.

It is certified that error appears in the above-identified patent and that said Letters Patent is hereby corrected as shown below:

Column 5,
Lines 37 and 55, replace ""Weight percentage - minimum" (second occurrence) with -- "weight percentage - maximum" --.

Column 6,
Lines 3, 27, 43 and 61, replace ""Weight percentage - minimum" (second occurrence) with -- "weight percentage - maximum" --.

Column 7,
Lines 3 and 16, replace ""Weight percentage - minimum" (second occurrence) with -- "weight percentage - maximum" --.

Column 8,
Line 22, replace ""claim 23" with -- claim 16 --.

Signed and Sealed this

Third Day of August, 2004

JON W. DUDAS
*Acting Director of the United States Patent and Trademark Office*